US005423356A

United States Patent [19]

Reckersdrees

[11] Patent Number: 5,423,356

[45] Date of Patent: Jun. 13, 1995

[54] FILLING PIPE FOR USE IN A FILLING MACHINE FOR FILLING IN PARTICULAR VALVE SACKS

[75] Inventor: Thomas Reckersdrees, Atlanta, Ga.

[73] Assignee: Haver & Boecker, Germany

[21] Appl. No.: 197,121

[22] Filed: Feb. 16, 1994

[30] Foreign Application Priority Data

Feb. 24, 1993 [DE] Germany ..... 43 05 527.3

[51] Int. Cl.[6] ..... B65B 1/04

[52] U.S. Cl. ..... 141/67; 141/65; 141/315

[58] Field of Search ..... 141/68, 67, 65, 166, 141/165, 315

[56] References Cited

U.S. PATENT DOCUMENTS

| | | | |
|---|---|---|---|
| 3,118,474 | 1/1964 | Eppolito | 141/68 |
| 3,294,127 | 12/1966 | Lau | 141/68 |
| 4,219,054 | 8/1980 | Carter et al. | 141/68 X |
| 4,311,173 | 1/1982 | Sailors, Jr. | 141/68 |
| 4,550,755 | 11/1985 | Vrendenburg | 141/67 X |
| 4,574,720 | 3/1986 | Lepisto | 141/68 X |
| 4,974,646 | 12/1990 | Martin et al. | 141/67 |
| 4,976,296 | 12/1990 | Pope | 141/67 X |

FOREIGN PATENT DOCUMENTS

| | | | |
|---|---|---|---|
| 3834810 | 4/1990 | Germany | 141/68 |

*Primary Examiner*—Ernest G. Cusick
*Attorney, Agent, or Firm*—Henry M. Feiereisen

[57] ABSTRACT

A filling pipe for use in a filling machine for filling in particular valve sacks, comprises a pipe body with an end piece which a closure ring defining an outlet opening and made of a filter material. The closure ring is surrounded by a ring chamber which is in fluid communication an air conduit for allowing evacuation of the ring chamber after termination of a filling process and, optionally, admittance of air after fitting an empty valve sack onto the pipe body.

13 Claims, 1 Drawing Sheet

FILLING PIPE FOR USE IN A FILLING MACHINE FOR FILLING IN PARTICULAR VALVE SACKS

BACKGROUND OF THE INVENTION

The present invention refers to a filling pipe for use in a filling machine for filling sacks or bags, especially valve sacks, and refers in particular to a filling pipe of the type having a ring chamber which is in fluid communication with an air conduit.

A conventional filling pipe is provided on one end with a connection flange for attachment to the filling machine, with the outlet opening of the filling pipe situated on the opposite end of the connection flange. German patent no. DE 38 34 810 A1 describes a filling pipe which allows admittance of pressurized air via the air conduit into the ring chamber after withdrawing the valve sack from the filling pipe for cleaning the filling pipe. Suitably, the filling pipe has a perforated forward portion or a forward portion in form of a wire fabric, with the ring chamber being spaced from the free end of the filling pipe.

This conventional filling pipe has the drawback that the valve sack cannot be filled sufficiently accurate with a predetermined desired weight since material trickles out after termination of the filling process, thus adversely affecting the weight accuracy. Moreover, subsequently outflowing material not only contaminates the filling machine but is also annoying to the operating personnel. It was thus proposed to equip the conventional filling pipe with a suction hood.

In order to avoid a trickling out of material, German patent no. DE 38 07 254 C1 describes the attachment of a tubular body inside the filling pipe, with both ends of the tubular body being secured to the filling pipe. The tubular body is acted upon by pressurized air and made of elastically deformable material. After stopping the filling process, pressurized air is admitted to push the tubular body together from outside such that the central area of the tubular body forms a T-shaped configuration for closing the passageway through the filling pipe. The forward end of the tubular body is forced outwards from the outlet or filling opening in form of a bubble to keep this space free from material. A drawback of this filling pipe is its complicated structure for preventing an outflow of material after terminating the filling process.

SUMMARY OF THE INVENTION

It is thus an object of the present invention to provide an improved filling pipe obviating the afore-stated drawbacks.

In particular, it is an object of the present invention to provide an improved filling pipe by which the tolerance range in regard to the actual weight of filled sacks is significantly smaller compared to conventional filling pipes.

It is yet another object of the present invention to provide an improved filling pipe which is of simple structure and yet keeps the environment of the filling machine dustfree.

It is still another feature of the present invention to provide an improved filling pipe which is usable for rotary packaging machines, serial packaging machines and filing machines with a downpipe.

These objects and others which will become apparent hereinafter are attained in accordance with the present invention by surrounding the outlet opening of the filling pipe with a closure ring of filter material which is encircled by a ring chamber such as to allow evacuation of air from the ring chamber after termination of the filling process and, optionally, admittance of air after fitting an empty valve sack onto the filling pipe.

The provision of a closure ring to define the outlet opening of the filling pipe permits an immediate evacuation of the ring chamber which surrounds the closure ring after stopping the filling process to thereby generate in the forward area of the filling pipe an air flow which is drawn through the closure ring. Since this closure ring is made of filter material, air can pass therethrough while filled material and even dust particles are held back. Thus, the closure ring acts as a pneumatic lock of the filling pipe to eliminate an outflow of contents after the filling process is interrupted, thereby significantly increasing the accuracy of the weight of the material being charged in the valve sack. Moreover, there is no necessity to provide additional suction devices so that the overall structure of the filling pipe is significantly less complicated than conventional designs.

After attachment of an empty sack onto the filling pipe, the vacuum is relieved and pressurized air is admitted into the ring chamber to forcefully remove previously retained dust particles from the closure ring and thereby avoid a progressive clogging thereof. Moreover, material deposits which may collect are removed by the sudden blast of pressurized air in the forward area of the filling pipe.

Since its durability is not infinite, the closure ring must be periodically replaced. In order to keep the time for replacement negligible, it is proposed in accordance with another feature of the present invention to design the filling pipe as a two-part construction, with a main pipe body and an end piece in form of an annular changing cartridge which is detachably secured to the main pipe body and represents the forward end of the filling pipe with the outlet opening. A changing cartridge can thus be prepared with an operational closure ring for subsequent attachment to the main pipe body, to thereby complete the filling pipe. The time for replacement of the changing cartridge can be further shortened by providing between the facing surfaces of the filling pipe and the changing cartridge in the end area distant to the outlet opening a second ring chamber which is continuously evacuated and suitably sealed at both end faces through sealing rings. The vacuum in the second ring chamber forces the changing cartridge onto the pipe body of the filling pipe. When relieving the vacuum, the changing cartridge can be easily withdrawn. Moreover, the provision of such a vacuum eliminates the need for further connecting or locking elements.

BRIEF DESCRIPTION OF THE DRAWING

The above and other objects, features and advantages of the present invention will now be described in more detail with reference to the accompanying drawing in which the sole

DETAILED DESCRIPTION OF A PREFERRED EMBODIMENT

Figure 1:
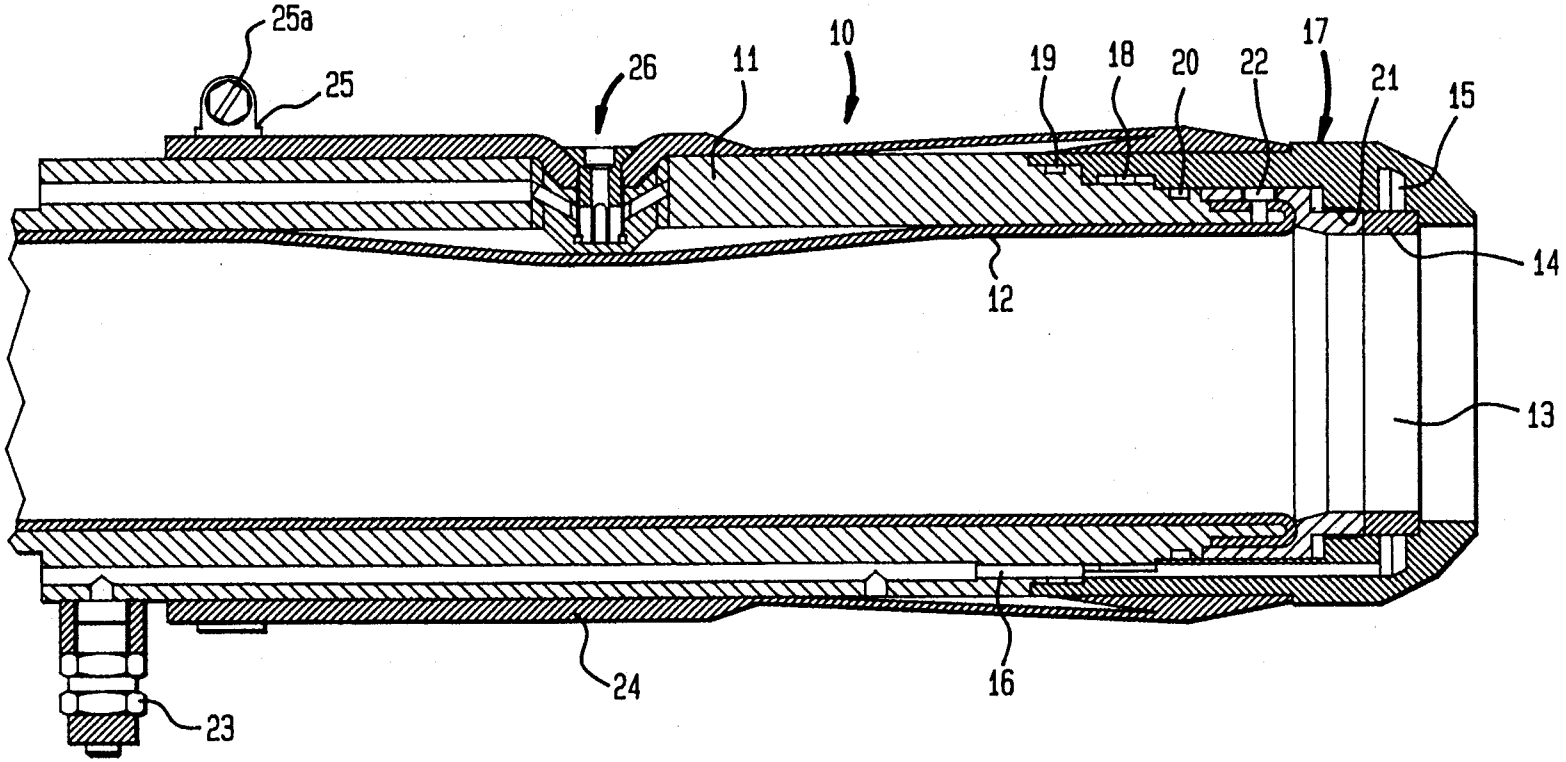
FIG. 1 is a partial sectional view of a filling pipe according to the present invention.

Referring now to FIG. 1, there is shown a partial sectional view of a filling pipe, generally designated by reference numeral 10. The filling pipe is generally of two-part structure, with an elongated pipe body 11 having a forward end and a rearward end (not shown)

suitably provided with a connection flange for attachment to a not shown filling machine, and with a changing cartridge, generally designated by reference numeral 17. The changing cartridge 17 is detachably fitted onto the forward end of the pipe body 11 and defines an outlet opening 13 through which material is discharged from the filling pipe 10 into a not shown valve sack. Lining the inside of the pipe body 11 is a wear-resistant tube which is folded around the axial end face of the pipe body 11 and kept in place by an annular compressor 21 of generally Z-shaped configuration. The compressor 21 is sandwiched with one section thereof between the inside surface of the changing cartridge 17 and the opposite surface of the pipe body 11 and secured to the pipe body 11 by screws 22. The provision of the inner tube 12 is advantageous in connection with filling into the valve sack flow-resistant material which has a tendency to stick the pipe body 11.

The changing cartridge 17 houses a closure ring 14 which surrounds the outlet opening 13 and is made of a suitable filter material such as felt. The closure ring 14 is detachably placed within the changing cartridge 17 to allow an easy replacement thereof and is encircled by a ring chamber 15 which has an axial width smaller than the axial width of the closure ring 14. As shown in FIG. 1, the compressor 21 has a second section sandwiched in axial direction to the filling pipe 10 between the closure ring 14 and the axial end of the tube 12 so as to essentially continue the inside diameter of the pipe body 11.

The ring chamber 15 which is preferably of angular configuration, is in fluid communication with an air conduit 16 for allowing evacuation and admission of pressurized air into the ring chamber 15 through a connection piece 23 which is suitably connected to a vacuum source or a source for pressurized air.

The changing cartridge 17 is placed onto the forward axial end of the pipe body 11, with the length of the cartridge 17 being small relative to the axial length of the filling pipe 10. As shown in FIG. 1, the facing surfaces of the pipe body 11 and the changing cartridge 17 are substantially of complementary step-shaped configuration. At a distance to the outlet opening 13, the changing cartridge 17 is slightly recessed to define with the respective outer wall section of the pipe body 11 a ring chamber 18 which is suitably sealed at each side by sealing rings 19, 20. The ring chamber 18 is in fluid communication with a not shown vacuum source to maintain a vacuum within the ring chamber 18 by which the changing cartridge 17 is held upon the pipe body 11.

In the area of the outlet opening 13, the changing cartridge 17 has an inside diameter which essentially corresponds to the outside diameter of the axial end face of the pipe body 11. In this manner, a suitable space is created for the compressor 21 and the closure ring 14.

The pipe body 11 is surrounded by an inflatable outer expandable tube 24 which is secured to the pipe body 11 via a clip 25 tightened by a screw 25*a*. The expandable tube 24 seals the feed valves of the valve sack during the filling process to eliminate material from being blown to the outside.

As further shown in FIG. 1, the pipe body 11 is provided at a distance to the changing cartridge 17 with a control unit, generally designated by reference numeral 26 which monitors whether or not a valve sack is placed onto the filling pipe 10. When a valve sack is attached to the filling pipe 10 and covers the formed recess, the control unit 26 triggers the filling process. Since the control unit 26 does not form pad of the invention, a detailed description thereof has been omitted for sake of simplicity.

After a valve sack is filled, the ring chamber 15 is evacuated, creating an air flow through the closure ring 14 which prevents material from flowing out of the filling pipe 10. The closure ring 14 thus acts as a pneumatic or vacuum lock of the filling pipe 10. Thereafter, the filled valve sack can be removed and a subsequent empty sack placed over the filling pipe 10, with the vacuum in the ring chamber 15 being relieved. Thereafter, a blast of pressurized air is admitted into the ring chamber 15 to clean the closure ring 14 and to remove deposits in the area of the outlet opening 13.

During operation of the filling machine, a vacuum is maintained in the second ring chamber 18 in order to secure the changing cartridge 17 onto the filling pipe 10. In case the closure ring 14 should be replaced, the vacuum in the second ring chamber 18 is relieved to allow easy withdrawal of the changing cartridge 17 from the filling pipe 10. The cartridge 17 is then provided with a new closure ring 14 and secured to the filling pipe 10, with the compressor 21 preventing a twisting of the inner tube 12 during attachment of the changing cartridge 17. Thereafter, the ongoing filling operation can be continued which is thus only momentarily interrupted.

While the invention has been illustrated and described as embodied in a filling pipe for use in a filling machine for filling in particular valve sacks, it is not intended to be limited to the details shown since various modifications and structural changes may be made without departing in any way from the spirit of the present invention.

What is claimed as new and desired to be protected by Letters Patent is set forth in the appended claims:

1. A filling pipe for use in a filling machine for filling in particular valve sacks, comprising:

a pipe body;

a changing cartridge having an annular cross section and detachably secured to said pipe body, said changing cartridge including a closure ring which defines an outlet opening and is made of a filter material, and a first ring chamber surrounding said closure ring; and passageway means disposed within said pipe body and including an air conduit in fluid communication with said first ring chamber for selectively allowing evacuation of said first ring chamber after termination of a filling process and admittance of air after fitting an empty valve sack onto said pipe body, wherein said changing cartridge defines with said pipe body a second ring chamber which is evacuated for securing said changing cartridge to said pipe body during the filling process.

2. The filling pipe of claim 1 wherein said ring chamber has a width and said closure ring has a width, the width of said ring chamber being smaller than the width of said closure ring.

3. The filling pipe of claim 1 wherein said first ring chamber is of angular configuration.

4. The filling pipe of claim 1 wherein said pipe body and said changing cartridge have complementary stepped surfaces.

5. A filling pipe for use in a filling machine for filling in particular valve sacks, comprising:

a pipe body having an end piece which includes a closure ring defining an outlet opening and made of a filter material, said end piece including a first ring chamber surrounding said closure ring and defining with said pipe body a second ring chamber which is evacuated for securing said end piece to said pipe body; and passageway means disposed within said pipe body and including an air conduit in fluid communication with said first ring chamber for selectively allowing evacuation of said first ring chamber after termination of a filling process and admittance of air after fitting an empty valve sack onto said pipe body wherein said first ring chamber has a width and said closure ring has a width, the width of said first ring chamber being smaller than the width of said closure ring.

6. The filling pipe of claim 5 wherein said end piece is a changing cartridge of annular cross section and detachably securable to said pipe body.

7. The filling pipe of claim 5 wherein said ring chamber is of angular configuration.

8. The filling pipe of claim 5 wherein said pipe body and said changing cartridge have complementary stepped surfaces.

9. A filling pipe for use in a filling machine for filling in particular valve sacks, comprising:

a pipe body having an end piece defining an outlet opening for discharge of material, said end piece including a closure ring made of a filter material and situated adjacent said outlet opening, and a first ring chamber surrounding said closure ring; and passageway means disposed within said pipe body and including an air conduit in fluid communication with said first ring chamber for allowing evacuation of said first ring chamber after termination of a filling process in order to generate a suction action only in the area of said outlet opening, said end piece defining with said pipe body a second ring chamber which is evacuated for securing said end piece to said pipe body.

10. The filling pipe of claim 9 wherein said ring chamber has a width and said closure ring has a width, the width of said ring chamber being smaller than the width of said closure ring.

11. The filling pipe of claim 9 wherein said end piece is a changing cartridge of annular cross section and detachably securable to said pipe body.

12. The filling pipe of claim 11 wherein said pipe body and said changing cartridge have complementary stepped surfaces.

13. The filling pipe of claim 9 wherein said first ring chamber is of angular configuration.

* * * * *